US010513373B2

(12) United States Patent
Yang et al.

(10) Patent No.: US 10,513,373 B2
(45) Date of Patent: Dec. 24, 2019

(54) COLLAPSIBLE TUBE SQUEEZING DEVICE

(71) Applicants: Meng-Hsun Yang, New Taipei (TW); Kai-En Kang, New Taipei (TW)

(72) Inventors: Meng-Hsun Yang, New Taipei (TW); Kai-En Kang, New Taipei (TW)

( * ) Notice: Subject to any disclaimer, the term of this patent is extended or adjusted under 35 U.S.C. 154(b) by 0 days.

(21) Appl. No.: 15/921,356

(22) Filed: Mar. 14, 2018

(65) Prior Publication Data

US 2019/0092534 A1 Mar. 28, 2019

(30) Foreign Application Priority Data

Sep. 27, 2017 (TW) ..... 106133068 A

(51) Int. Cl.
*B65D 35/32* (2006.01)
*B65D 35/28* (2006.01)

(52) U.S. Cl.
CPC ..... *B65D 35/32* (2013.01); *B65D 35/28* (2013.01)

(58) Field of Classification Search
CPC ..... B65D 35/32; B65D 35/28
See application file for complete search history.

(56) References Cited

U.S. PATENT DOCUMENTS

| | | | | |
|---|---|---|---|---|
| 3,759,421 | A * | 9/1973 | Hausmann | B65D 35/32 222/99 |
| 4,576,314 | A * | 3/1986 | Elias | B65D 35/32 222/103 |
| 5,685,457 | A * | 11/1997 | Liberatore | B65D 35/28 222/100 |
| 6,247,618 | B1 * | 6/2001 | Liberatore | B65D 35/32 222/100 |
| 9,365,328 | B1 * | 6/2016 | Johnson | B65D 35/32 |
| 2010/0314409 | A1 * | 12/2010 | Gashi | B65D 35/28 222/100 |
| 2015/0274376 | A1 * | 10/2015 | Weber | B65D 35/34 222/100 |

* cited by examiner

*Primary Examiner* — Donnell A Long
(74) *Attorney, Agent, or Firm* — Hamre, Schumann, Mueller & Larson, P.C.

(57) ABSTRACT

A collapsible tube squeezing device includes a tubular member and a rotary member. A tubular wall of the tubular member has a slit which extends in an axial direction through two opened ends. The rotary member has a tubular shaft rotatably disposed in the tubular wall about an axis, a handle connected to a shaft end for a manual rotational operation, and a centered member connected to an opposite shaft end, and configured to be kept and centered along the axis. A shaft wall of the tubular shaft is coaxial with and spaced apart from the tubular wall, and has a slot for a sealed end of a collapsible tube to be inserted thereinto.

5 Claims, 5 Drawing Sheets

COLLAPSIBLE TUBE SQUEEZING DEVICE

CROSS-REFERENCE TO RELATED APPLICATION

This application claims priority of Taiwanese Patent Application No. 106133068, filed on Sep. 27, 2017.

FIELD

The disclosure relates to a collapsible tube squeezing device, and more particularly to a collapsible tube squeezing device for expelling a material from a collapsible tube.

BACKGROUND

Generally, many types of viscous cleansing materials (such as facial cleansers, toothpaste, etc.), in form of gels, liquids, paste, and the like, are each filled in a respective collapsible tube, and are dispensed therefrom by pressing the collapsible tube with a user's hand. Many squeezing devices have been proposed and used to aid in expelling of the viscous material from the collapsible tube. A common squeezer includes a flat elongated plate formed with a slot so as to be sleeved on a sealed end of the collapsible tube in use, such that the squeezer can be pushed forwardly toward an opened end to expel the viscous material from the collapsible tube. However, it is known that such squeezer cannot efficiently expel all of the viscous material due to the large size of the slot. Reducing the size of the slot renders sleeving of the squeezer on the collapsible tube inconvenient and troublesome. Another conventional squeezer has been developed to express the viscous material from a collapsible tube and wind up the emptied tube portion on a rotary shaft. Such squeezer has a relatively complicated structure that is inconvenient to manufacture and not easy to use.

SUMMARY

Therefore, an object of the disclosure is to provide a collapsible tube squeezing device that can alleviate at least one of the drawbacks of the prior art.

According to the disclosure, a collapsible tube squeezing device includes a tubular member and a rotary member. The tubular member has a tubular wall which is elongated in an axial direction to terminate at two opposite first and second opened ends and to define an accommodating space therein, and which has a slit that extends in the axial direction through the first and second opened ends and that penetrates radially through the tubular wall to be in spatial communication with the accommodating space. The rotary member has a tubular shaft which is rotatably disposed in the accommodating space about an axis in the axial direction, and which is elongated along the axis to terminate at two opposite first and second shaft ends that are disposed in the first and second opened ends, respectively, a handle which is connected to the first shaft end and disposed outwardly of the accommodating space, and a centered member which is connected to the second shaft end. The centered member is configured to permit axial insertion thereof into the accommodating space from the first opened end to be disposed in the second opened end, and to be kept and centered along the axis. The tubular shaft has a shaft wall which surrounds the axis and which is spaced apart from the tubular wall of the tubular member, and a slot which extends in the axial direction and which penetrates radially through the shaft wall for a sealed end of a collapsible tube to be inserted thereinto.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
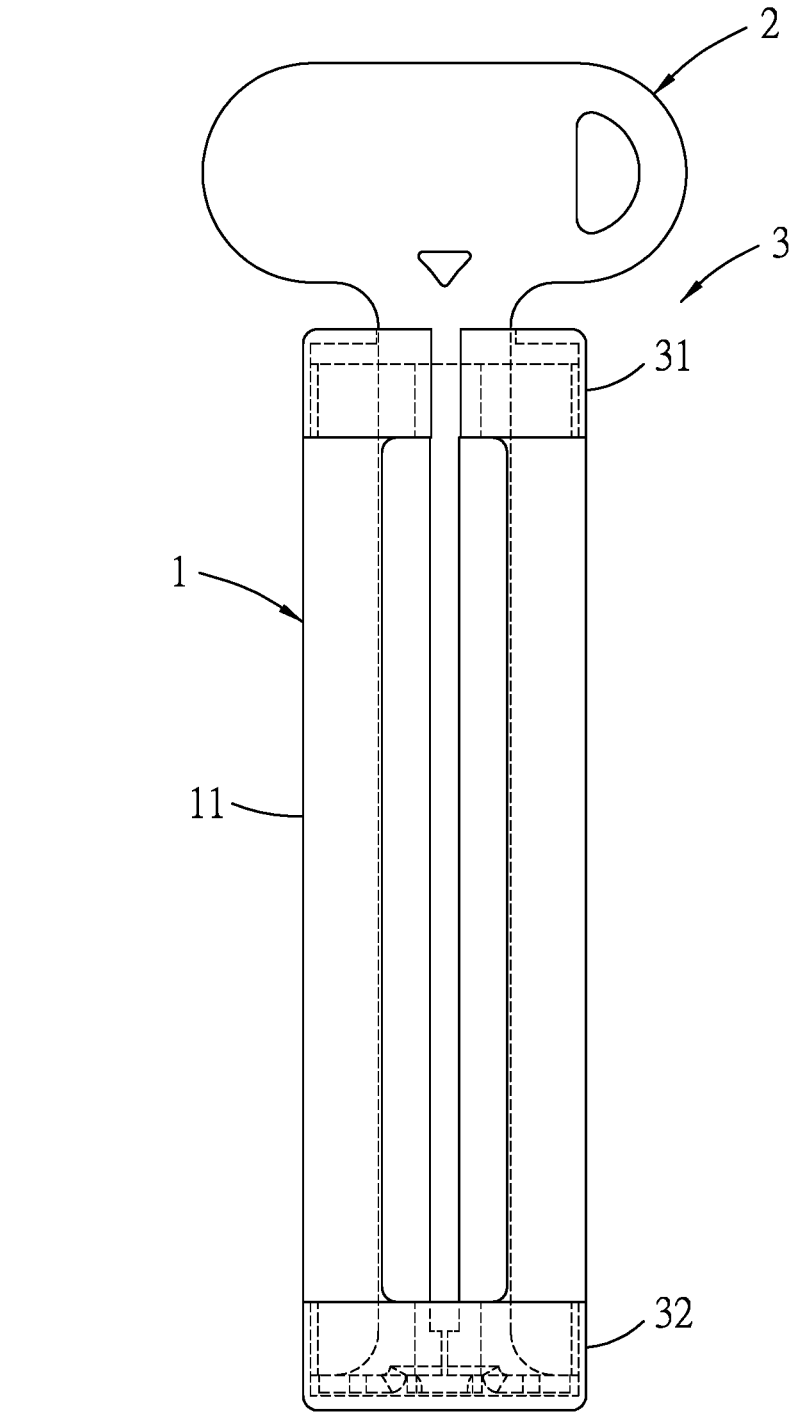
FIG. 1 is a front schematic view of an embodiment of a collapsible tube squeezing device according to the disclosure.
Figure 2:
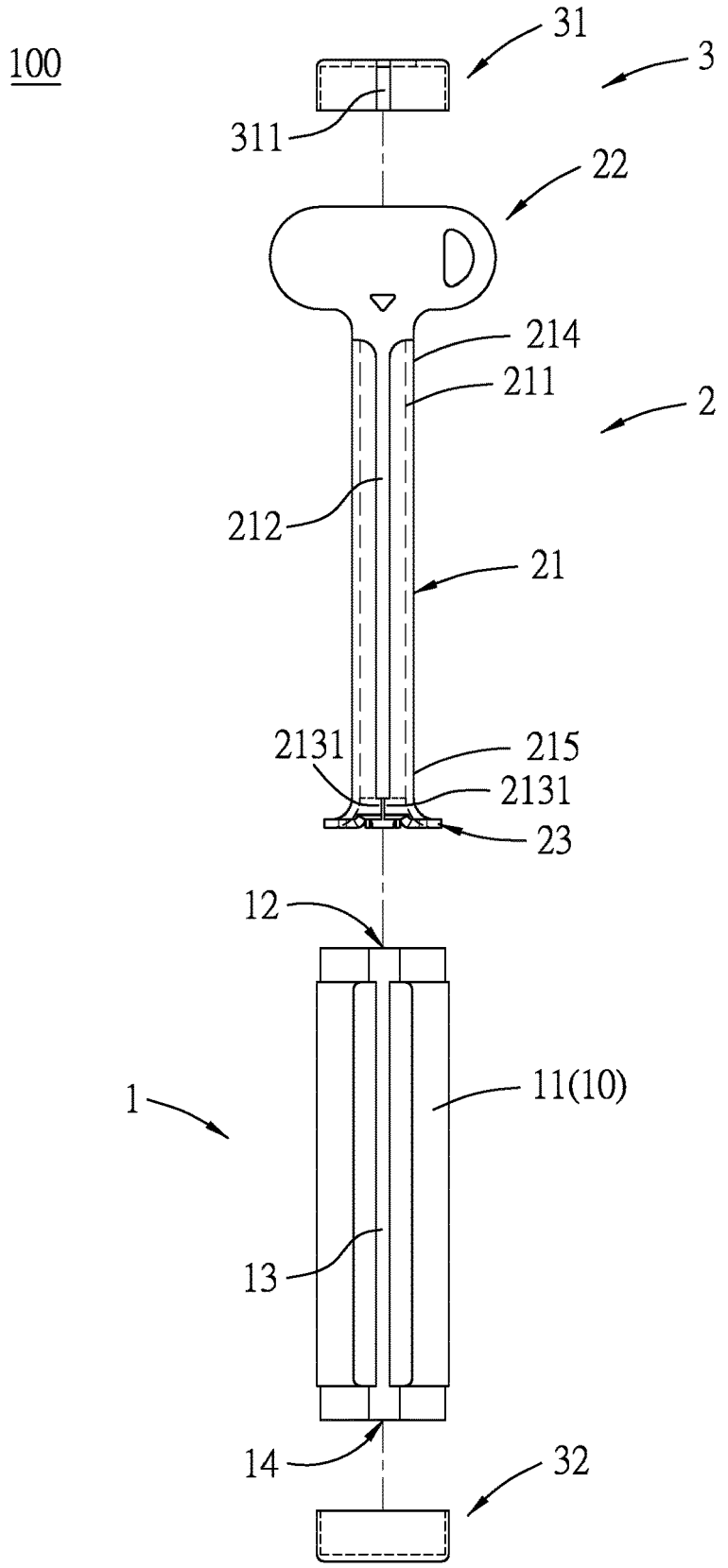
FIG. 2 is an exploded view of the embodiment.
Figure 3:
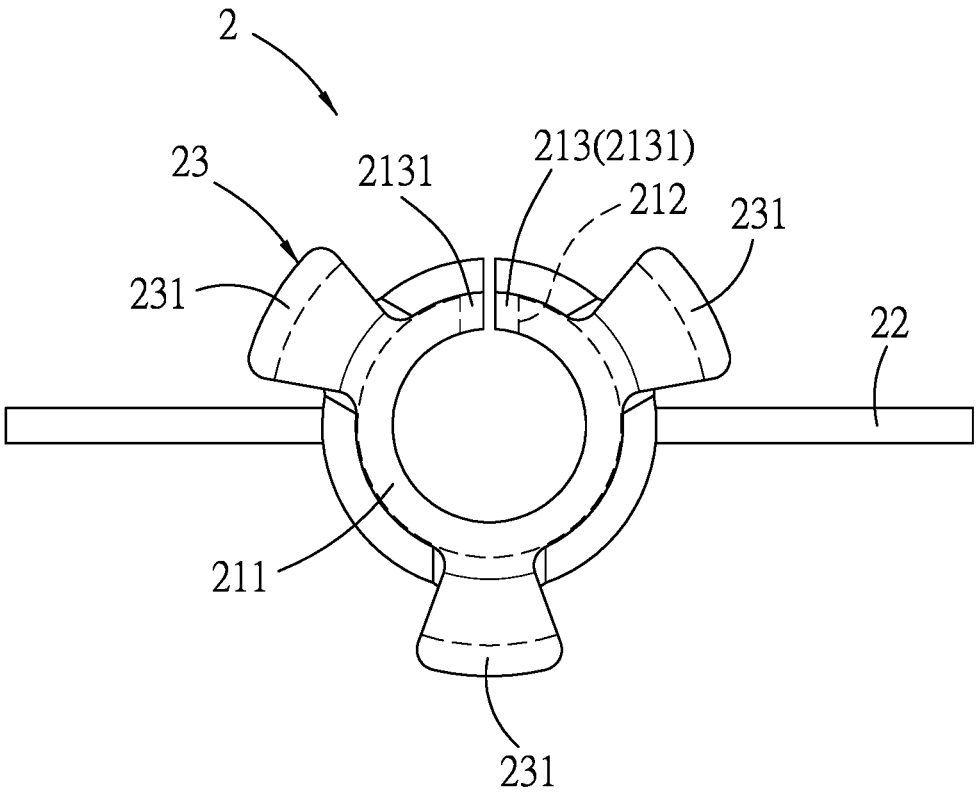
FIG. 3 is a bottom view of the embodiment.
Figure 4:
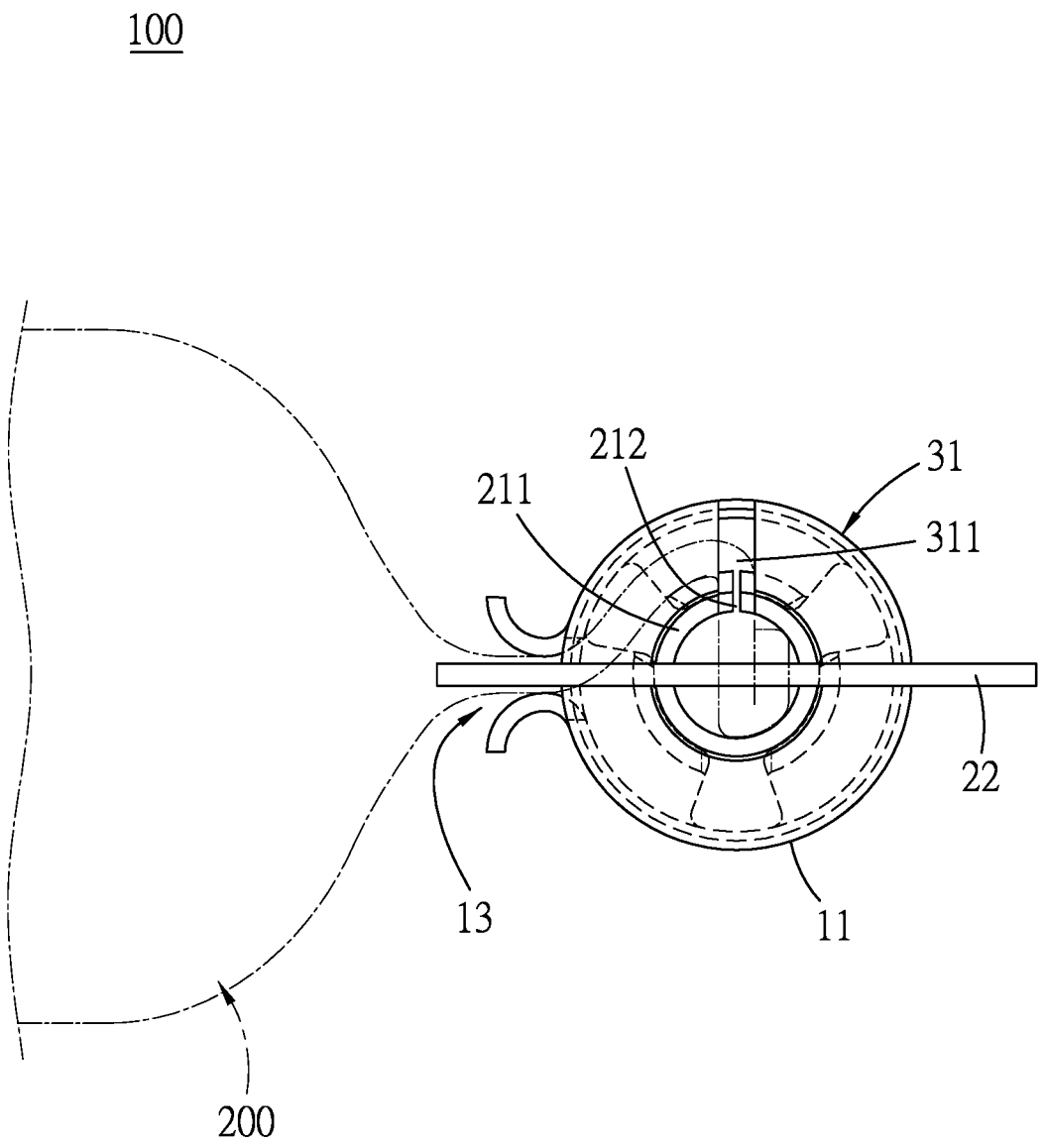
FIG. 4 is a schematic view of the embodiment illustrating a state of use.
Figure 5:
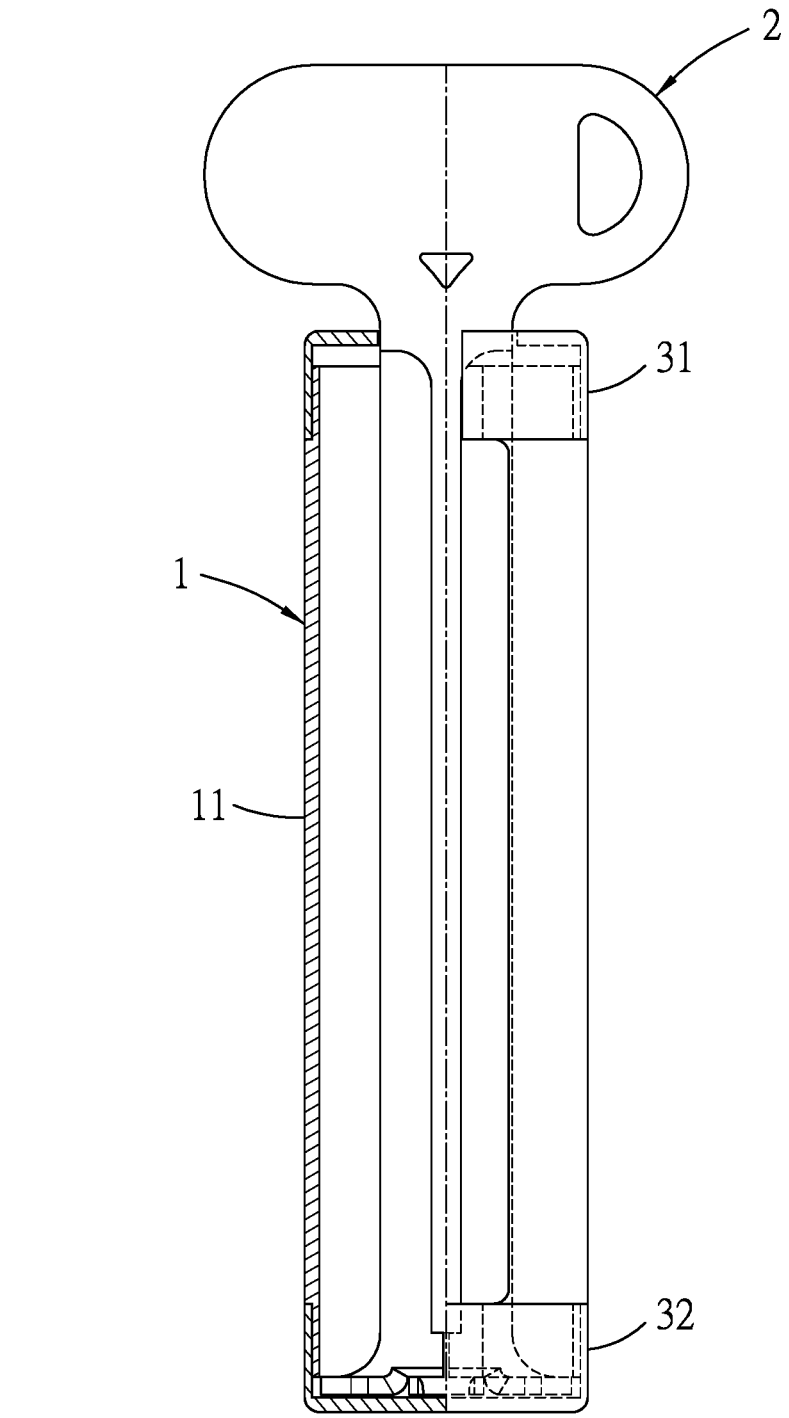
FIG. 5 is a schematic, partly-sectional view of the embodiment.

Referring to FIGS. 1 to 5, an embodiment of a collapsible tube squeezing device 100 is adapted for squeezing a collapsible tube 200 which contains a viscous cleansing material, such as toothpaste, a facial cleanser, lotion, and the like. The collapsible tube 200 is made of a flexible plastic material for example.

The squeezing device 100 includes a tubular member 1, a rotary member 2 and a centering structure 3. The tubular member 1 is made of a plastic or metal material, and is translucent, semi-translucent or non-translucent. The tubular member 1 has a tubular wall 11 which is elongated in an axial direction to terminate at two opposite first and second opened ends 12, 14 and to define an accommodating space 10 therein. The tubular wall 11 has a C-shaped cross-section to have a slit 13 which extends in the axial direction through the first and second opened ends 12, 14, and which penetrates radially through the tubular wall 11 to be in spatial communication with the accommodating space 10. The slit 13 is tapered radially and inwardly for facilitating insertion of the collapsible tube 200.

The rotary member 2 is made of a plastic or metal material, and is translucent, semi-translucent or non-translucent. The rotary member 2 has a tubular shaft 21, a handle 22 and a centered member 23. The tubular shaft 21 is rotatable disposed in the accommodating space 10 of the tubular member 1 about an axis in the axial direction, and is elongated along the axis to terminate at two opposite first and second shaft ends 214, 215 that are disposed in the first and second opened ends 12, 14, respectively. The tubular shaft 21 has a shaft wall 211 which surrounds the axis to be coaxial with and spaced apart from the tubular wall 11 of the tubular member 1. The shaft wall 211 has a C-shaped cross-section to have a slot 212 which extends in the axial direction and penetrates radially through the shaft wall 211. A sealed end of the collapsible tube 200 is inserted into the shaft wall 211 through the slit 13 and the slot 212 by axially moving the sealed end from the first opened end 12 toward the second opened end 14. The tubular shaft 21 further has a narrowed portion 213 which is disposed in the slot 212 at the second shaft end 215. The narrowed portion 213 may be two protrusions 2131 that are formed by protruding from two opposite edges of the slot 212 toward each other so as to define therebetween a width that is smaller than the width of the slot 212. An axial movement of the sealed end of the collapsible tube 200 can be stopped by the narrowed portion 213. Alternatively, the narrowed portion 213 may be formed as one protrusion, or two protrusions connected to each other. The handle 22 is integrally connected to the first shaft end 214 and is disposed outwardly of the accommodating space 10. In this embodiment, the handle 22 is in the form of an oval flat plate for facilitating grip and rotation by a user. The centered member 23 is integrally connected to the second shaft end 215 and adjacent to the narrowed portion 213. The centered member 23 is configured to permit axially insertion thereof into the accommodating space 10 from the first opened end 12 to be disposed in the second opened end 14, and to be kept and centered along the axis. The centered member 23 is configured to be flared outwardly from the second shaft end 215 of the tubular shaft 21. In this embodiment, the centered member 23 has three arcuate plates 231 which are angularly displaced from each other about the axis, and which extend radially and outwardly of the tubular shaft 21.

The centering structure 3 includes a first end cap 31 and a second end cap 32 that are removably mounted on the first and second opened ends 12, 14, respectively, to confine the first and second shaft ends 214, 215 to have the same aligned along the axis. Specifically, the second end cap 32 has an end wall disposed transverse to the axial direction. The centered member 23 has an annular end edge which is received in the second end cap 32. The annular end edge is formed with the arcuate plates 231 which rotatably and fittingly abut against the end wall of the second end cap 32 so as to keep the rotary member 2 extending along the axis for ensuring rotation thereof about the axis. Further, the first end cap 31 has a split 311 which extends in the axial direction therethrough to be aligned with the slit 13 of the tubular member 1 for extension of the collapsible tube 200.

In use, the first end cap 31 is removed from the tubular member 1. The sealed end of the collapsible tube 200 is inserted into the slit 13 and the slot 212 by an axial movement thereof from the first opened end 12 and the first shaft end 214 toward the second opened end 14 and the second shaft end 215. The axial movement of the sealed end can be stopped by the narrowed portion 213. Then, the first end cap 31 is mounted on the tubular member 1 to firmly hold the sealed end and to further keep and center the rotary member 2 along the axis so as to aid in rotating the collapsible tube 200 more efficiently. Hence, through the rotation of the rotary member 2 by the user, a portion of the collapsible tube 200 is squeezed by passing through the slit 13 of the tubular member 1 and is then wound onto the tubular shaft 21 so as to ensure that all of the viscous material in the wound portion of the collapsible tube 200 has been expelled. By rotating the rotary member 2 in the opposite rotational direction, the collapsible tube 200 can be removed from the squeezing device 100.

Particularly, when a collapsible tube 200 made of aluminum, lead material and containing a high-viscosity material, such as pigments for hairdressing, pasty lubricants for motors, etc., is used, with the tubular wall 11 of a C-shaped cross-section which has the slit 13 tapered radially and inwardly to form two beveled inner surfaces, the high-viscosity material near the sealed end can be expelled to have this part of the tube 200 flat and thinner, which renders the winding of the tube 200 around the tubular shaft 21 and the rotation of the rotary member 2 easier and smooth so as to solve the problem that such tube does not efficiently expel the high-viscosity material.

As illustrated, the squeezing device 100 of the disclosure includes the tubular member 1, the rotary member 2, and the first and second end caps 31, 32, each of which has a simple structure and a simple configuration to be easy and convenient to manufacture. The rotary member 2 is mounted and centered firmly in the tubular member 1 along the axis to be reliably rotated during operation, such that the sealed end of the collapsible tube 200 can be firmly engaged with the tubular shaft 21 and all of the viscous material can be expelled. Besides, the slit 13 of the tubular member 1 can be made wider for facilitating insertion of the collapsible tube 200 without adversely affecting squeezing and winding of the collapsible tube 200.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A collapsible tube squeezing device comprising:

a tubular member having a tubular wall which is elongated in an axial direction to terminate at two opposite first and second opened ends and to define an accommodating space therein, and which has a slit that extends in the axial direction through said first and second opened ends and that penetrates radially through said tubular wall to be in spatial communication with said accommodating space;

a rotary member having a tubular shaft which is rotatably disposed in said accommodating space about an axis in the axial direction, and which is elongated along the axis to terminate at two opposite first and second shaft ends that are disposed in said first and second opened ends, respectively, a handle which is connected to said first shaft end and disposed outwardly of said accommodating space, and a centered member which is connected to said second shaft end, said centered member being configured to permit axial insertion thereof into said accommodating space from said first opened end to be disposed in said second opened end, and to be kept and centered along the axis, said tubular shaft having a shaft wall which surrounds the axis and which is spaced apart from said tubular wall of said tubular member, and a slot which extends in the axial direction and which penetrates radially through said shaft wall for a sealed end of a collapsible tube to be inserted thereinto, a centering structure which includes a first end cap and a second end cap that are removably mounted on said first and second opened ends, respectively, to confine said first and second shaft ends to have the same aligned along the axis, said second end cap being configured to fittingly accommodate said centered member and having an end wall which is disposed transverse to the axial direction to permit abutment of said centered member thereagainst.

2. The collapsible tube squeezing device as claimed in claim 1, wherein said centered member is configured to be flared outwardly from said second shaft end of said tubular shaft to have an annular end edge that is received in said second end cap and rotatably and fittingly abuts against said end wall of said second end cap, said first end cap having a split which extends in the axial direction therethrough to be aligned with said slit of said tubular member for extension of the collapsible tube.

3. The collapsible tube squeezing device as claimed in claim 2, wherein said annular end edge of said centered member has a plurality of arcuate plates which are angularly displaced from each other about the axis and which extend radially and outwardly of said tubular shaft.

4. The collapsible tube squeezing device as claimed in claim 1, wherein said slit of said tubular member is tapered radially and inwardly.

5. The collapsible tube squeezing device as claimed in claim 1, wherein said tubular shaft has a narrowed portion which is disposed in said slot at said second shaft end and adjacent to said centered member and which defines a width smaller than that of said slot so as to stop an axial movement of the sealed end of the collapsible tube from said first shaft end.

* * * * *